US009308774B2

(12) United States Patent
Heim

(10) Patent No.: US 9,308,774 B2
(45) Date of Patent: Apr. 12, 2016

(54) SECURITY ELEMENT COMPRISING A SCREENED LAYER

(75) Inventor: Manfred Heim, Bad Tolz (DE)

(73) Assignee: Giesecke & Devrient GmbH, Munich (DE)

( * ) Notice: Subject to any disclaimer, the term of this patent is extended or adjusted under 35 U.S.C. 154(b) by 180 days.

(21) Appl. No.: 12/997,130

(22) PCT Filed: May 28, 2009

(86) PCT No.: PCT/EP2009/003794

§ 371 (c)(1),
(2), (4) Date: Dec. 9, 2010

(87) PCT Pub. No.: WO2009/149833

PCT Pub. Date: Dec. 17, 2009

(65) Prior Publication Data

US 2011/0091665 A1 Apr. 21, 2011

(30) Foreign Application Priority Data

Jun. 12, 2008 (DE) ..... 10 2008 027 952

(51) Int. Cl.
*B44F 1/06* (2006.01)
*B42D 25/29* (2014.01)
(Continued)

(52) U.S. Cl.
CPC . *B44F 1/06* (2013.01); *B42D 25/29* (2014.10); *B42D 25/324* (2014.10); *B42D 25/328* (2014.10); *B42D 2033/04* (2013.01); *B42D 2035/14* (2013.01); *B42D 2035/16* (2013.01)

(58) Field of Classification Search
CPC .. B42D 2033/00; B42D 25/29; B42D 25/324; B42D 25/328; B42D 2033/04; B42D 2035/16; B42D 2035/14; B44F 1/06
USPC ..... 428/195.1; 283/72
See application file for complete search history.

(56) References Cited

U.S. PATENT DOCUMENTS 4,557,596 A 12/1985 Mueller et al.
4,659,113 A 4/1987 Mueller et al.
(Continued)

FOREIGN PATENT DOCUMENTS

DE 3130182 A1 2/1983
EP 0251253 A2 1/1988
(Continued)

OTHER PUBLICATIONS

International Search Report, English translation, International Application No. PCT/EP2009/003794, Feb. 23, 2010, 3 pages.
(Continued)

*Primary Examiner* — Mark Ruthkosky
*Assistant Examiner* — Laura C Powers
(74) *Attorney, Agent, or Firm* — Lathrop & Gage LLP

(57) ABSTRACT

The present invention relates to a security element composed of at least one light-transmitting substrate on which a substantially opaque, screened layer composed of grid elements is located. According to the present invention, within the substantially opaque, screened layer composed of grid elements, at least one thin, solid, substantially opaque line is arranged that exhibits the form of at least one alphanumeric character, a graphic or a pattern. Such lines have line widths of at least 0.1 mm to 5 mm, preferably of 0.2 mm to 0.7 mm, particularly preferably of about 0.5 mm. Instead of lines, also extensive regions without any gap may be used, such that the alphanumeric character, pattern or graphic formed is perceptible only in transmitted light, but not in reflected light. The security element thus displays, at least when viewed from the side of the substantially opaque, screened layer, in top view, a different appearance than when looked through.

19 Claims, 2 Drawing Sheets

Figure 1:
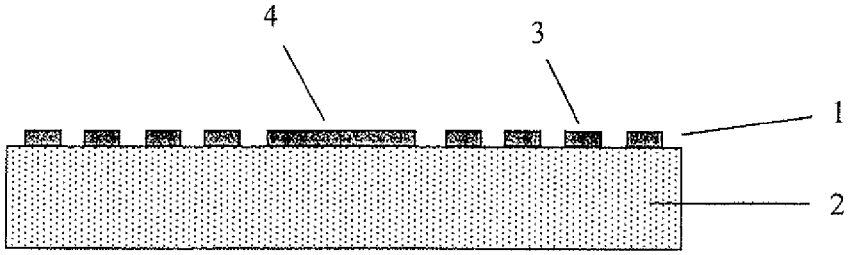

(51) Int. Cl.
*B42D 25/324* (2014.01)
*B42D 25/328* (2014.01)

(56) References Cited

U.S. PATENT DOCUMENTS

| | | | | |
|---|---|---|---|---|
| 5,988,503 | A * | 11/1999 | Kuo | 235/457 |
| 6,491,324 | B1 * | 12/2002 | Schmitz et al. | 283/82 |
| 6,586,098 | B1 | 7/2003 | Coulter et al. | |
| 6,699,313 | B2 | 3/2004 | Coulter et al. | |
| 6,982,832 | B2 | 1/2006 | Wild et al. | |
| 7,316,422 | B1 * | 1/2008 | Schmitz | 283/91 |
| 7,667,894 | B2 | 2/2010 | Hoffmuller | |
| 7,728,931 | B2 | 6/2010 | Hoffmuller | |
| 7,808,605 | B2 | 10/2010 | Hoffmuller | |
| 7,986,459 | B2 | 7/2011 | Kaule | |
| 8,083,894 | B2 | 12/2011 | Gruszczynski | |
| 2005/0104364 | A1 * | 5/2005 | Keller et al. | 283/72 |
| 2006/0097511 | A1 * | 5/2006 | Keller | 283/72 |
| 2007/0165182 | A1 * | 7/2007 | Hoffmuller et al. | 349/187 |
| 2007/0211238 | A1 | 9/2007 | Hoffmuller | |
| 2007/0216518 | A1 | 9/2007 | Hoffmuller | |
| 2007/0229928 | A1 | 10/2007 | Hoffmuller | |
| 2007/0241553 | A1 | 10/2007 | Heim | |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 * | 7/2008 | Kaule et al. | 428/29 |
| 2008/0163994 | A1 | 7/2008 | Hoppe | |
| 2008/0198468 | A1 | 8/2008 | Kaule | |
| 2008/0216976 | A1 | 9/2008 | Ruck | |
| 2008/0250954 | A1 | 10/2008 | Depta | |
| 2008/0258456 | A1 | 10/2008 | Rahm | |
| 2009/0001709 | A1 | 1/2009 | Kretschmar | |
| 2009/0008923 | A1 | 1/2009 | Kaule | |
| 2009/0008926 | A1 | 1/2009 | Depta | |
| 2009/0102605 | A1 | 4/2009 | Kaule | |
| 2009/0115185 | A1 | 5/2009 | Hoffmuller | |
| 2009/0236061 | A1 | 9/2009 | Gruszczynski | |
| 2009/0297805 | A1 | 12/2009 | Dichtl | |
| 2009/0322071 | A1 | 12/2009 | Dichtl | |
| 2010/0175843 | A1 | 7/2010 | Gregarek | |
| 2010/0177094 | A1 | 7/2010 | Kaule | |
| 2010/0182221 | A1 | 7/2010 | Kaule | |
| 2010/0194091 | A1 | 8/2010 | Heim | |
| 2010/0194532 | A1 | 8/2010 | Kaule | |
| 2010/0196587 | A1 | 8/2010 | Keller | |
| 2010/0207376 | A1 | 8/2010 | Heim | |
| 2010/0208036 | A1 | 8/2010 | Kaule | |
| 2010/0307705 | A1 | 12/2010 | Rahm | |
| 2010/0308570 | A1 | 12/2010 | Heim | |
| 2010/0320742 | A1 | 12/2010 | Hoffmuller | |
| 2011/0007374 | A1 | 1/2011 | Heim | |
| 2011/0012337 | A1 | 1/2011 | Heim | |
| 2011/0027538 | A1 | 2/2011 | Hoffmann | |
| 2011/0045248 | A1 | 2/2011 | Hoffmuller | |
| 2011/0069360 | A1 | 3/2011 | Dichtl | |
| 2011/0079997 | A1 | 4/2011 | Heim | |

FOREIGN PATENT DOCUMENTS

| | | | |
|---|---|---|---|
| EP | 1415828 | A1 | 5/2004 |
| EP | 1503907 | A1 | 2/2005 |
| EP | 1864825 | A1 | 12/2007 |
| WO | WO 84/02309 | A1 | 6/1984 |
| WO | WO 01/03944 | A1 | 1/2001 |
| WO | WO 01/03945 | A1 | 1/2001 |
| WO | WO 03/006261 | A1 | 1/2003 |
| WO | WO 03/095228 | A1 | 11/2003 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006015733 | | 2/2006 |
| WO | WO 2006018171 | | 2/2006 |
| WO | WO 2006018172 | | 2/2006 |
| WO | WO 2006040069 | | 4/2006 |
| WO | WO 2006056342 | | 6/2006 |
| WO | WO 2006072380 | | 7/2006 |
| WO | WO 2006087138 | | 8/2006 |
| WO | WO 2006099971 | | 9/2006 |
| WO | WO 2006119896 | | 11/2006 |
| WO | WO 2006128607 | | 12/2006 |
| WO | WO 2007006445 | | 1/2007 |
| WO | WO 2007006455 | | 1/2007 |
| WO | WO 2007076952 | | 7/2007 |
| WO | WO 2007079851 | | 7/2007 |
| WO | WO 2007115648 | | 10/2007 |
| WO | WO 2008/000350 | | 1/2008 |
| WO | WO 2008/000351 | | 1/2008 |
| WO | WO 2008/049533 | | 5/2008 |
| WO | WO 2008/061636 | | 5/2008 |
| WO | WO 2008/071325 | | 6/2008 |
| WO | WO 2009/000527 | | 12/2008 |
| WO | WO 2009/000528 | | 12/2008 |
| WO | WO 2009/000529 | | 12/2008 |
| WO | WO 2009/000530 | | 12/2008 |
| WO | WO 2009/012893 | | 1/2009 |
| WO | WO 2009/024265 | | 2/2009 |
| WO | WO 2009/080262 | | 7/2009 |
| WO | WO 2009/080263 | | 7/2009 |
| WO | WO 2009/083146 | | 7/2009 |
| WO | WO 2009/083151 | | 7/2009 |
| WO | WO 2009/100831 | | 8/2009 |
| WO | WO 2009/100869 | | 8/2009 |
| WO | WO 2009/109291 | | 9/2009 |
| WO | WO 2009/121578 | | 10/2009 |

OTHER PUBLICATIONS

International Preliminary Report on Patentability, International Application No. PCT/EP2009/003794, Mar. 8, 2011, English Translation, 5 pages.

* cited by examiner

SECURITY ELEMENT COMPRISING A SCREENED LAYER

CROSS-REFERENCE TO RELATED APPLICATIONS

This application is the U. S. National Stage of International Application No. PCT/EP2009/003794, filed May 28, 2009, which claims the benefit of German Patent Application DE 10 2008 027 952.8, filed Jun. 12, 2008; both of which are hereby incorporated by reference to the extent not inconsistent with the disclosure herewith.

The present invention relates to a security element composed of at least one light-transmitting substrate on which a substantially opaque, screened layer composed of grid elements is located.

Security elements composed of at least one light-transmitting substrate on which a substantially opaque, screened layer composed of grid elements is located are known from the background art.

For example, from EP 1503907 A1 is known a thin-film element composed of a reflective, a dielectric and a partially transmissive or absorbing layer. Here, the absorbing layer is contiguously vapor deposited or imprinted and partially ablated again by means of ablation methods such as etching, laser ablation and spark erosion. Furthermore, a partial application of the partially transmissive layer is possible through vapor deposition with evaporation masks designed in the form of patterns. The partially transmissive layer thus consists of a substantially opaque, screened layer composed of grid elements.

From EP 1 415 828 A1 is known a security feature for a document, the security feature consisting of a first and a second pattern. Here, the first pattern is arranged on a first surface of the document and consists of a first sub-image and a first background pattern. The second pattern consists of a second sub-image and a second background pattern and is arranged on a second surface of the document that lies opposite the first surface. The first pattern and the second pattern produce a so-called see-through register: if the first pattern is aligned with the second pattern through the accordingly sufficiently transparent document, the first sub-image and the second sub-image produce a complete image. In return, the complete image disappears when the first pattern is not aligned with the second pattern.

From EP 0 251 253 A2 is known a security document having a carrier and a hologram attached to the carrier. In addition, a display composed of liquid crystal can be located below the hologram.

The object of the present invention is to develop a generic security element in such a way that the protection vis-à-vis counterfeits is further increased.

This object is solved by the features of the independent claims. Developments of the present invention are the subject of the dependent claims.

According to the present invention, within the substantially opaque, screened layer composed of grid elements, at least one thin, solid, substantially opaque line is arranged that exhibits the form of at least one alphanumeric character, a graphic or a pattern. Such lines have line widths of at least 0.1 mm to 5 mm, preferably of 0.2 mm to 0.7 mm, particularly preferably about 0.5 mm. The thin, solid, substantially opaque line can also be formed by an extensive region without any gap.

The security element thus displays, at least when viewed from the side of the substantially opaque, screened layer, in top view, a different appearance than when looked through.

The security element according to the present invention is preferably applied on a data carrier having a light-transmitting, preferably translucent and particularly preferably transparent region. Here, the data carrier is especially a value document, such as a banknote, a security paper, a credit or identification card, a passport, a certificate and the like, a label, packaging or another element for product protection. The light-transmitting region is, for example, a window in the form of a through opening that is covered by a light-transmitting, preferably translucent, particularly preferably transparent, foil. Thus, the security element according to the present invention is visible from both sides of the data carrier.

Here, transparent is understood to mean a transmittance of at least 90% of the impinging light, and translucent a transmittance of under 90%, preferably between 80% and 20%. Within the meaning of the present invention, a substantially opaque layer has a transmittance of less than 20%, preferably under 10% and particularly preferably about 0%.

The substantially opaque, screened layer preferably consists of a plurality of grid elements. Here, the grid elements are either gaps in the substantially opaque layer and thus form a kind of negative image, or they are substantially opaque, spaced apart basic pattern elements and thus form a kind of positive image.

Within the meaning of the present invention, viewing in reflected light is illuminating the security element from one side and viewing the security element from the same side. Thus, a viewing in reflected light occurs, for example, when the front of the security element is illuminated and also viewed.

Within the meaning of the present invention, viewing in transmitted light is illuminating a security element from one side and viewing the security element from another side, especially the opposing side. Thus, a viewing in transmitted light occurs, for example, when the reverse of the security element is illuminated and the front of the security element is viewed. The light thus shines through the security element.

In a particularly preferred embodiment, the grid elements are arranged stochastically and/or in grid form. Within the meaning of the present invention, a grid is a uniform or non-uniform distribution of grid elements, the grid elements being spaced apart from one another.

Here, through continuous and location-dependent variation of the density or size of the grid elements, more complex patterns up to halftone images can be produced in transmitted light.

Here, the individual grid elements are executable in arbitrary shapes. If particular forms of the grid elements are chosen, then this can even constitute an additional security feature, for example grid elements in the form of a text or a micrographic.

The share of the total area of the plurality of grid elements with respect to the total surface area of the security element is 10% to 40%, preferably about 20%.

The substantially opaque, screened layer preferably consists of metal or of a printed layer.

If the substantially opaque, screened layer consists of metal, the surface of the substrate to which the grid elements are applied can, at least in sub-regions, be provided with embossed diffractive patterns or an embossing lacquer layer having diffractive patterns embossed in it. In this case, the metallic grid elements reflect the impinging light such that the diffractive patterns form a hologram, subwavelength grating or blazed grating or a matte pattern.

Likewise, at least one translucent, liquid crystal layer can be applied over the substantially opaque, screened layer.

Furthermore, at least one optically variable thin-film layer consisting of at least one dielectric layer can be applied over the substantially opaque, screened layer. If the substantially opaque, screened layer composed of grid elements is developed as a reflective layer, the thin-film layer additionally exhibits at least one partially transmissive layer. If, in contrast, the substantially opaque, screened layer composed of grid elements is developed as a partially transmissive layer, the thin-film layer additionally exhibits at least one reflective layer. In both cases, the resulting thin-film layer thus consists of a reflective layer, a middle dielectric layer and a partially transmissive layer, and in addition, also the reflective layer or partially transmissive layer that lies opposite the grid elements can exhibit grid elements or gaps.

Especially the following are used as materials for the respective layers of the interference-capable thin-film layer:

- for the reflective layer, reflective substances, especially metals such as aluminum, silver or copper,
- for the dielectric layer, $SiO_2$ (silicon dioxide), $ZrO_2$ (zirconium dioxide), $MgF_2$ (magnesium difluoride) or $TiO_2$ (titanium dioxide) or other transparent substances, such as very thin and extremely uniformly imprinted transparent lacquers,
- for the partially transmissive layer, chrome and/or nickel, iron, silver, gold, or alloys thereof, such as Inconel™ (Ni—Cr—Fe).

Further materials for the respective layers of the interference-capable structure and especially their respective layer thicknesses are listed in publications WO 01/03945 A1, U.S. Pat. No. 6,586,098 B1 and U.S. Pat. No. 6,699,313 B2. The disclosure of the cited publications is incorporated in the present application by reference.

The individual layers of the security element can be imprinted and/or vapor deposited onto a substrate, for example by means of known printing methods or by means of vacuum deposition, such as sputtering, reactive sputtering, physical vapor deposition or chemical vapor deposition. Here, absorber materials, dielectrics and reflector materials are imprinted and/or vapor deposited onto the substrate in, in each case, stacked or overlapping layers.

The metals that may be used for the reflective and partially transmissive layer are required in very thin layers having layer thicknesses of about 5 nm to 100 nm. These layers are preferably applied by means of vacuum deposition, the relevant metal being heated up and evaporated, in a vacuum, by means of a heating device, for example a resistor or an electron beam. The metal then separates out as a thin layer on a foil moving past. For the application of the dielectric layer, having layer thicknesses between 100 nm and 1 μm, the various variants of the vacuum vapor deposition method are likewise appropriate. To produce uniform colors, it is necessary here to keep the layer thickness extremely uniform, which especially sputtering or also well controlled thermal or electron beam vapor deposition methods provide. Alternatively, the transparent dielectric can also be applied in the form of a transparent ink by means of a printing method. Here, however, extreme care is necessary in the coating process to ensure the required layer thickness uniformity, with a tolerance of, for example, ±2%.

For the patterning or demetalization of the layers, advantageously the known methods such as washing processes, etching, oil ablation, lift-off or laser demetalization are used.

For the sake of better comprehensibility, the illustrations in the following figures are highly schematized and do not reflect the real conditions. Especially the proportions shown in the figures do not correspond to the actual ratios and serve solely to improve clarity. Furthermore, for the sake of better comprehensibility, the embodiments described in the following examples are reduced to the essential core information. In practical implementation, significantly more complex patterns or images can be used.

Figure 2:
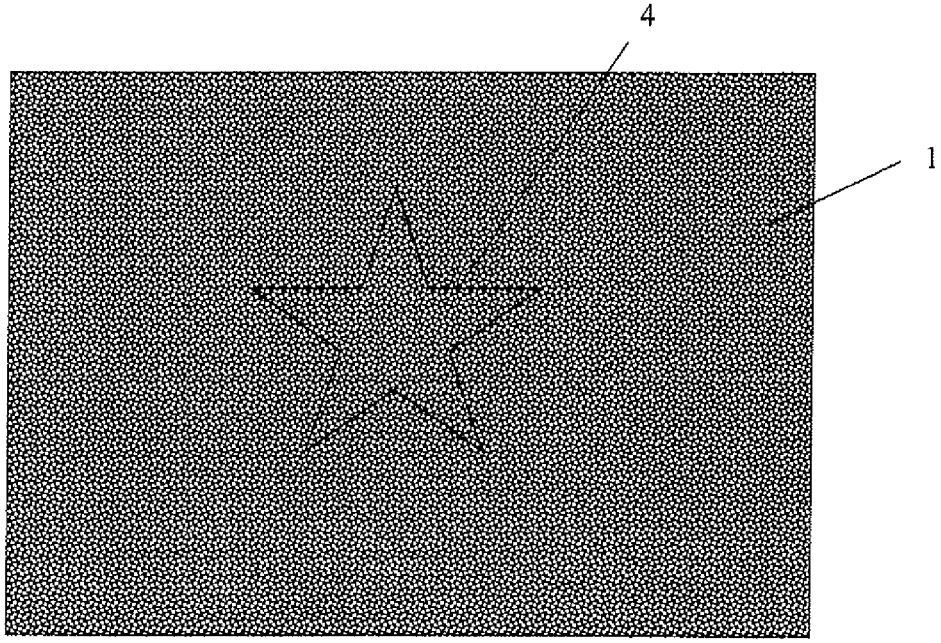
Figure 3:
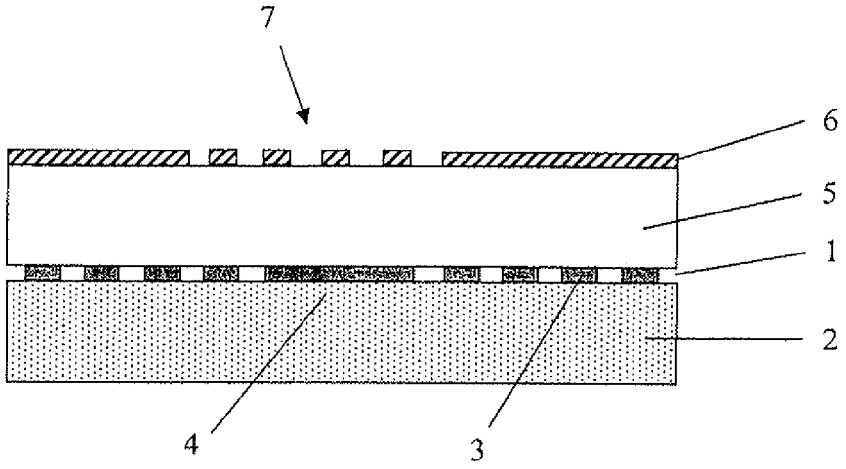
Figure 4:
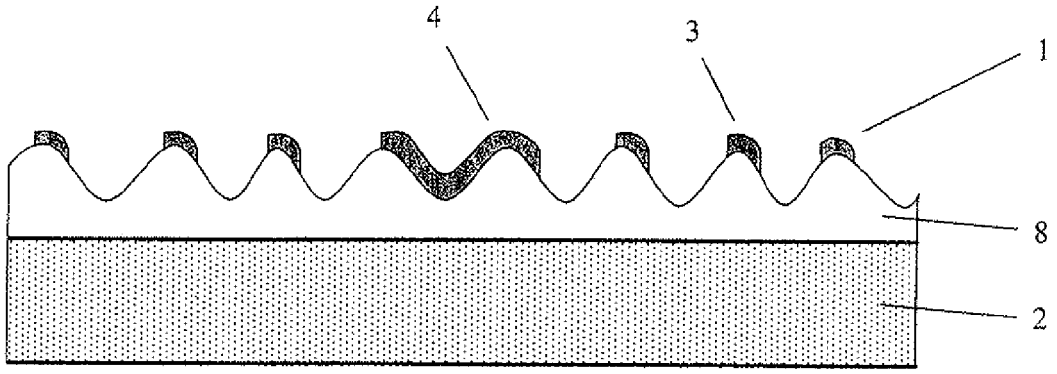

Specifically, the figures depict schematically:

FIG. 1 a security element according to the present invention, composed of at least one light-transmitting substrate on which a substantially opaque, screened layer composed of grid elements and a thin, solid, substantially opaque line is located, in side view, FIG. 2 the inventive security element from FIG. 1, in top view, with the thin, solid, substantially opaque line forming a five-pointed star, FIG. 3 the inventive security element from FIG. 1, that, together with two further layers that are applied to the substantially opaque, screened layer composed of grid elements, forms an optically variable thin-film layer, in side view, FIG. 4 a security element according to the present invention, in which, on a substrate, an embossing lacquer having an embossing pattern is applied on which the substantially opaque, screened layer composed of grid elements and a thin, solid, substantially opaque line are located, in side view.

FIG. 1 shows an inventive security element composed of at least one light-transmitting substrate 2 on which a substantially opaque, screened layer 1 composed of grid elements 3 and a thin, solid, substantially opaque line 4 is located, in side view.

The grid elements 3 are executed to be circular and/or line-shaped, the circular gaps exhibiting a diameter of 10 micrometers to 100 micrometers, preferably of 30 micrometers to 50 micrometers, and the line-shaped gaps a width of 30 micrometers to 70 micrometers.

FIG. 2 shows the inventive structure pursuant to FIG. 1 in transmitted light, viewed from the side of the reflective layer 3. Within the grid elements 3 is located a thin, solid line 4 in the form of a five-pointed star. This line exhibits a width of 0.1 mm to 5 mm, such that the line is sufficiently conspicuous in transmitted light. In reflected light, it is not perceptible for a viewer, nearly independently of its line width. Thus, in transmitted light, the viewer sees the star, and in reflected light, no star.

FIG. 3 shows the inventive security element from FIG. 1, that, together with two further layers 5 and 6 that are applied to the grid elements 3 and the line 4, forms an optically variable thin-film layer. Here, the layer 5 forms a dielectric layer. The layer 6 and the grid elements 3 together with the line 4 form the reflective layer or the partially transmissive layer.

The layer 6 is executed to be either contiguous or, additionally, as depicted in FIG. 3, composed of grid elements in the region 7.

The security element according to the present invention is particularly advantageously combined with known optically active micropatterns, such as diffractive embossed holograms, zero-order gratings, refractive micropatterns, such as blazed gratings and the like.

FIG. 4 shows an example of such a combination with an embossed hologram. On the substrate 2 is applied an embossing lacquer 8 having an embossing pattern. On the embossing lacquer 8 is located the substantially opaque, screened layer 1 composed of grid elements 3 together with the thin, solid, substantially opaque line 4.

The invention claimed is:

1. A security element comprising: at least one light-transmitting substrate comprising a first and second surface, a screened layer which is substantially opaque, comprising grid elements formed on the first surface of the at least one light-transmitting substrate, and at least one, thin, solid, substantially opaque line in the form of at least one alphanumeric character, a graphic or a pattern formed within the screened layer, wherein, when the security element is viewed from the first surface of the substrate, the security element displays a different appearance when viewed in reflected light than when viewed in transmitted light, such that when viewed in reflected light only the screened layer of the security element is perceptible to a viewer and the at least one, thin, solid, substantially opaque line is not perceptible to a viewer; in transmitted light both the screened layer and the at least one, thin, solid, substantially opaque line of the security element are perceptible to a viewer.

2. The security element according to claim 1, characterized in that the thin, solid, substantially opaque line exhibits a width of at least 0.1 mm to 5 mm.

3. The security element according to claim 1, characterized in that the thin, solid, substantially opaque line is formed by an extensive region without any gap.

4. The security element according to claim 1, characterized in that the screened layer consists of a plurality of grid elements, and the grid elements are gaps in the screened layer.

5. The security element according to claim 4, characterized in that the grid elements can have an arbitrary form and be arranged stochastically and/or in grid form and/or vary locally in their diameter or their separation from one another.

6. The security element according to claim 5, characterized in that the grid elements are executed to be circular and/or line-shaped, and circular grid elements exhibit a diameter of 10 micrometers to 100 micrometers.

7. The security element according to claim 1, characterized in that the share of the total area of the grid elements with respect to the total surface area of the security element is 10% to 40%.

8. The security element according to claim 1, characterized in that the screened layer consists of metal.

9. The security element according to claim 1, characterized in that over the screened layer is applied at least one optically variable thin-film layer consisting of at least one dielectric layer and at least one partially transmissive or reflective layer.

10. The security element according to claim 1, characterized in that over the screened layer is applied at least one light-transmitting, liquid crystal layer.

11. The security element according to claim 8, characterized in that the surface of the substrate to which the screened layer comprising grid elements is applied exhibits, at least in sub-regions, embossed diffractive patterns or an embossing lacquer layer having diffractive patterns embossed in it.

12. A method for manufacturing the security element according to claim 1, characterized in that the grid elements are imprinted or vapor deposited on the light-transmitting substrate or are produced by demetalization from a layer that, at least in sub-regions, is contiguously vapor deposited on the substrate.

13. The method according to claim 12, characterized in that the vapor deposition of the grid elements occurs by means of vacuum deposition, such as sputtering, reactive sputtering, physical vapor deposition or chemical vapor deposition.

14. The method according to claim 12, characterized in that the demetalization occurs by means of washing processes, etching, oil ablation, lift-off or laser demetalization.

15. The method according to claim 13, characterized in that the demetalization occurs by means of washing processes, etching, oil ablation, lift-off or laser demetalization.

16. The security element according to claim 1, characterized in that the screened layer consists of a plurality of grid elements, and the grid elements are substantially opaque, spaced apart basic pattern elements.

17. The security element according to claim 16, characterized in that the grid elements can have an arbitrary form and be arranged stochastically and/or in grid form and/or vary locally in their diameter or their separation from one another.

18. The security element according to claim 16, characterized in that the grid elements are executed to be circular and/or line-shaped, and circular grid elements exhibit a diameter of 10 micrometers to 100 micrometers.

19. The security element according to claim 1, wherein the security element is applied to the surface of a data carrier.

* * * * *